US007133628B2

(12) United States Patent
Yamamoto et al.

(10) Patent No.: US 7,133,628 B2
(45) Date of Patent: Nov. 7, 2006

(54) IMAGE FORMING APPARATUS USING AN IMAGE CARRIER AND ROTARY DEVELOPER UNIT

(75) Inventors: Yoshihiro Yamamoto, Iwatsuki (JP); Yoshihito Sekikawa, Iwatsuki (JP); Kazuhiro Yoshino, Iwatsuki (JP); Kazuhiro Sone, Kashiwazaki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 175 days.

(21) Appl. No.: 10/793,231

(22) Filed: Mar. 5, 2004

(65) Prior Publication Data

US 2005/0069346 A1 Mar. 31, 2005

(30) Foreign Application Priority Data

Sep. 29, 2003 (JP) ..... 2003-337794

(51) Int. Cl.
*G03G 15/01* (2006.01)

(52) U.S. Cl. ..... 399/227

(58) Field of Classification Search ..... 399/227
See application file for complete search history.

(56) References Cited

U.S. PATENT DOCUMENTS 6,122,470 A * 9/2000 Kimura ..... 399/227
6,393,239 B1 * 5/2002 Arcaro et al. ..... 399/227
6,650,855 B1 * 11/2003 Tajima ..... 399/227
6,882,815 B1 * 4/2005 Iino ..... 399/227

FOREIGN PATENT DOCUMENTS

| | | |
|---|---|---|
| JP | 8-328348 | 12/1996 |
| JP | 2001-175077 | 6/2001 |
| JP | 2002-341706 | 11/2002 |

* cited by examiner

*Primary Examiner*—William J. Royer
(74) *Attorney, Agent, or Firm*—Morgan, Lewis & Bockius, LLP

(57) ABSTRACT

An image forming apparatus includes an image carrier, a rotary developer unit having a developing roll opposed to the image carrier when located at a developing position and an exposure device for writing a latent image onto the image carrier, wherein an optical path from the exposure device to the image carrier passes within a circumscribed circle of the developing roll with the center of rotation of the rotary developer unit as the center of the circle. The image carrier is located so as to provide the developing position above a horizontal line passing the center of rotation of the rotary developer unit, and the exposure device is located so as to provide a beam exit position below the horizontal line.

15 Claims, 14 Drawing Sheets

FIG. 6

| INCIDENT ANGLE θ | | IMAGE CARRIER RADIUS r (mm) | | | | | |
|---|---|---|---|---|---|---|---|
| DEGREES | RADIAN | 10 | 12 | 14 | 16 | 18 | 20 |
| 0 | 0 | 2.013579 | 2.009377 | 2.006866 | 2.005245 | 2.004138 | 2.003348 |
| 2 | 0.034907 | 2.022086 | 2.016601 | 2.013096 | 2.010916 | 2.009302 | 2.008109 |
| 4 | 0.069813 | 2.03327 | 2.026438 | 2.022101 | 2.019136 | 2.016996 | 2.015388 |
| 6 | 0.10472 | 2.047236 | 2.038977 | 2.033658 | 2.029975 | 2.027286 | 2.025244 |
| 8 | 0.139626 | 2.064114 | 2.054328 | 2.047966 | 2.043522 | 2.040254 | 2.037756 |
| 10 | 0.174533 | 2.08406 | 2.072625 | 2.065143 | 2.059887 | 2.056003 | 2.053021 |
| 12 | 0.20944 | 2.107261 | 2.09403 | 2.085335 | 2.079203 | 2.076457 | 2.071156 |
| 14 | 0.244346 | 2.133939 | 2.118732 | 2.108713 | 2.10163 | 2.096366 | 2.092304 |
| 16 | 0.279253 | 2.164358 | 2.14696 | 2.135481 | 2.127355 | 2.121307 | 2.116634 |
| 18 | 0.314159 | 2.198831 | 2.178982 | 2.165881 | 2.156601 | 2.14969 | 2.144346 |
| 20 | 0.349066 | 2.237733 | 2.215116 | 2.200198 | 2.189632 | 2.181761 | 2.175673 |
| 22 | 0.383972 | 2.281509 | 2.255738 | 2.238767 | 2.226754 | 2.217809 | 2.210892 |
| 24 | 0.418879 | 2.330698 | 2.301299 | 2.281985 | 2.268333 | 2.258175 | 2.250324 |
| 26 | 0.453786 | 2.385947 | 2.352333 | 2.330324 | 2.314797 | 2.303259 | 2.294349 |
| 28 | 0.488692 | 2.44805 | 2.409488 | 2.384347 | 2.366658 | 2.353535 | 2.343413 |
| 30 | 0.523599 | 2.517987 | 2.473547 | 2.444732 | 2.424524 | 2.409566 | 2.398047 |
| 32 | 0.558505 | 2.596985 | 2.545471 | 2.512296 | 2.489127 | 2.472023 | 2.458878 |
| 34 | 0.593412 | 2.686602 | 2.626455 | 2.588043 | 2.561352 | 2.541716 | 2.52666 |
| 36 | 0.628319 | 2.788865 | 2.718002 | 2.673214 | 2.642285 | 2.619625 | 2.602302 |
| 38 | 0.663225 | 2.906465 | 2.822037 | 2.769364 | 2.733268 | 2.706955 | 2.686912 |
| 40 | 0.698132 | 3.043098 | 2.941085 | 2.878482 | 2.835987 | 2.805202 | 2.781853 |

FIG. 10

| INCIDENT ANGLE θ | | IMAGE CARRIER RADIUS r (mm) | | | | | |
|---|---|---|---|---|---|---|---|
| DEGREES | RADIAN | 10 | 12 | 14 | 16 | 18 | 20 |
| 0 | 0 | 0.116648 | 0.096903 | 0.082904 | 0.072453 | 0.064349 | 0.05788 |
| 2 | 0.034907 | 0.158027 | 0.137982 | 0.123801 | 0.11323 | 0.105043 | 0.098514 |
| 4 | 0.069813 | 0.199968 | 0.179536 | 0.165115 | 0.154383 | 0.14608 | 0.139465 |
| 6 | 0.10472 | 0.242595 | 0.221685 | 0.206961 | 0.196021 | 0.187569 | 0.180841 |
| 8 | 0.139626 | 0.286043 | 0.264554 | 0.249459 | 0.238264 | 0.229625 | 0.222755 |
| 10 | 0.174533 | 0.330459 | 0.308279 | 0.292739 | 0.281234 | 0.272369 | 0.265326 |
| 12 | 0.20944 | 0.376006 | 0.353008 | 0.33694 | 0.325068 | 0.315932 | 0.308682 |
| 14 | 0.244346 | 0.422864 | 0.398905 | 0.382216 | 0.36991 | 0.360456 | 0.352961 |
| 16 | 0.279253 | 0.471235 | 0.446152 | 0.428736 | 0.415923 | 0.406094 | 0.398314 |
| 18 | 0.314159 | 0.521348 | 0.494951 | 0.476688 | 0.463283 | 0.453018 | 0.444903 |
| 20 | 0.349066 | 0.573465 | 0.545534 | 0.526281 | 0.512188 | 0.501416 | 0.492913 |
| 22 | 0.383972 | 0.627892 | 0.598161 | 0.577756 | 0.562861 | 0.5515 | 0.542546 |
| 24 | 0.418879 | 0.684983 | 0.653137 | 0.631383 | 0.615554 | 0.603509 | 0.59403 |
| 26 | 0.453786 | 0.745159 | 0.710815 | 0.687479 | 0.670559 | 0.657715 | 0.647628 |
| 28 | 0.488692 | 0.808925 | 0.771611 | 0.74641 | 0.728209 | 0.714432 | 0.703635 |
| 30 | 0.523599 | 0.876894 | 0.836022 | 0.808608 | 0.788897 | 0.774025 | 0.762396 |
| 32 | 0.558505 | 0.949826 | 0.904648 | 0.874588 | 0.853086 | 0.836919 | 0.824312 |
| 34 | 0.593412 | 1.028687 | 0.978225 | 0.944972 | 0.921326 | 0.903621 | 0.889855 |
| 36 | 0.628319 | 1.114673 | 1.057671 | 1.02052 | 0.994286 | 0.974736 | 0.959588 |
| 38 | 0.663225 | 1.209441 | 1.144153 | 1.10218 | 1.072785 | 1.051001 | 1.03419 |
| 40 | 0.698132 | 1.315193 | 1.239189 | 1.19115 | 1.157841 | 1.13332 | 1.114486 |

IMAGE FORMING APPARATUS USING AN IMAGE CARRIER AND ROTARY DEVELOPER UNIT

BACKGROUND OF THE INVENTION

1. Field of the Invention

The present invention relates to an image forming apparatus such as a printer, copier, and facsimile.

2. Description of a Related Art

As a color image forming apparatus, an apparatus for forming an image by a rotary developer unit having developing units of four colors of yellow, magenta, cyan, and black is known. Since the image forming apparatus of this type forms a color image by rotating the rotary developer unit to develop the image of the respective colors, other component parts such as a transfer device are disposed around the rotary developer unit (see JP-A-8-328348, JP-A-2001-175077, and JP-A-2002-341706).

However, when the exit position of a beam for writing a latent image onto an image carrier is approximated to the rotary developer unit in order to miniaturize the image forming apparatus, since the optical path is obstructed by the rotary developer unit, sometimes there is no choice but to make the incident angle of the beam on the image carrier larger relative to the normal line of the image carrier. Thus, if the incident angle of the beam on the image carrier becomes larger relative to the normal line of the image carrier, optical path shift due to manufacturing variations becomes easier to be produced, and, as a result, image defects are produced. In addition, a problem that the energy loss of the beam becomes larger sometimes arises.

Further, in the case where an exposure device is disposed below the rotary developer unit and the beam is output upwardly from the exposure device, sometimes the toner adheres to the exit portion of the beam and the image is disturbed.

SUMMARY OF THE INVENTION

Therefore, the first purpose of the invention is to miniaturize the image forming apparatus. Further, the second purpose of the invention is to reduce the energy loss of the beam for writing the latent image onto the image carrier by suppressing image defects due to manufacturing variations. Moreover, the third purpose of the invention is to reduce the disturbance of the image by preventing the toner from adhering to the exit portion of the beam for writing the latent image onto the image carrier.

In order to achieve the above described purposes, an aspect of the invention is an image forming apparatus including: an image carrier; a rotary developer unit having a developing roll opposed to the image carrier when located at a developing position; and an exposure device for writing a latent image onto the image carrier, wherein an optical path from the exposure device to the image carrier passes within a circumscribed circle of the developing roll with the center of rotation of the rotary developer unit as the center of the circle. Therefore, since the incident angle of the beam on the image carrier can be made smaller relative to the normal line of the image carrier even when the exit position of the beam for writing the latent image onto the image carrier is approximated to the rotary developer unit, the image forming apparatus can be miniaturized while suppressing damage to the image as much as possible.

Further, it is preferred that the exposure device outputs a beam so as to make an incident angle of the beam on the image carrier equal to or less than 30 degrees relative to the normal line of the image carrier. That is, since the incident angle of the beam is made equal to or less than 30 degrees relative to the normal line of the image carrier, the energy loss due to reflection of the beam can be reduced.

Another aspect of the invention is an image forming apparatus including: an image carrier; a rotary developer unit having a developing roll opposed to the image carrier when located at a developing position; and an exposure device for writing a latent image onto the image carrier, wherein the image carrier is located so as to provide the developing position above a horizontal line passing the center of rotation of the rotary developer unit, and the exposure device is located so as to provide a beam exit position below the horizontal line and out of a region formed by vertically projecting the image carrier to the rotary developer unit side. Therefore, the toner falling from the image carrier can be prevented from adhering to the beam exit position of the exposure device without making the installation area of the image forming apparatus broader by disposing the exposure device below both or one of the rotary developer unit and the image carrier, and thereby, the miniaturization of the image forming apparatus and the prevention of the disturbance of the image due to obstruction of the beam by the toner, which is the so called "cloud", can be achieved simultaneously.

Another aspect of the invention is an image forming apparatus including: an image carrier; a rotary developer unit having a developing roll opposed to the image carrier when located at a developing position; and an exposure device for writing a latent image onto the image carrier, wherein the image carrier is located so as to provide the developing position above a horizontal line passing the center of rotation of the rotary developer unit, and the exposure device is located so as to provide a beam exit position below the horizontal line and within a region formed by vertically projecting the rotary developer unit. Therefore, since the rotary developer unit obstructs the toner falling from the image carrier and adhering to the beam exit position of the exposure device without making the installation area of the image forming apparatus broader by disposing the exposure device below both or one of the rotary developer unit and the image carrier, the miniaturization of the image forming apparatus and the prevention of the so called "cloud" can be achieved simultaneously.

Further, it is preferred that the rotary developer unit further has a bottom plate, and the exposure device is located so as to provide the beam exit position within a region formed by vertically projecting the bottom plate. Therefore, even when the exposure device is disposed below the image carrier since the bottom plate of the rotary developer unit obstructs the toner falling from the image carrier and adhering to the beam exit position of the exposure device, the so called "cloud" can be prevented.

In addition, it is preferred that a beam passing portion is formed in the bottom plate, and an optical path from the exposure device to the image carrier via the beam passing portion is formed.

Another aspect of the invention is an image forming apparatus including: an image carrier; a rotary developer unit having a developing roll opposed to the image carrier when located at a developing position; and an exposure device for writing a latent image onto the image carrier, wherein the exposure device is located below the rotary developer unit, and outputs a beam in a direction substantially the same as a direction of rotation of the rotary developer unit. Therefore, the toner flying off when the rotary developer unit separates from the image carrier and falling on the beam exit position of the exposure device can be reduced even when the exposure device is disposed below the image carrier without making the installation area of the image forming apparatus broader by disposing the exposure device below the rotary developer unit, and thereby, the miniaturization of the image forming apparatus and the prevention of the so called "cloud" can be achieved simultaneously.

Further, it is preferred that the exposure device has a mounting portion, and the mounting portion is mounted to the main body of the image forming apparatus outside of the region formed by vertically projecting the rotary developer unit. Therefore, even when the exposure device is disposed below the rotary developer unit, the working space for attaching or detaching the exposure device by using a tool such as a driver can be assured.

In addition, it is preferred that the exposure device is disposed in a mounted position by being slid relative to the main body of the image forming apparatus. Therefore, the exposure device can be exchanged without detaching the rotary developer unit from the main body of the image forming apparatus.

Another aspect of the invention is an image forming apparatus including: an image carrier; a rotary developer unit having plural developing parts and moving to a developing position in which each of the developing parts is opposed to the image carrier by rotating around the predetermined center of rotation; and an exposure device disposed so as to allow light output by the exposure device to pass inside of a circumscribed circle along which the developing parts rotate.

According to the invention, the image forming apparatus can be miniaturized. Further, the energy loss of the beam for writing the latent image onto the image carrier can be reduced by suppressing image defects due to manufacturing variations etc. Moreover, the disturbance of the image can be reduced by preventing the toner from adhering to the exit portion of the beam for writing the latent image onto the image carrier.

BRIEF DESCRIPTION OF THE DRAWINGS

Preferred embodiments of the present invention will be described in detail based on the following figures, wherein:

FIG. 4-1 is a perspective view from above of the exposure device according to the embodiment of the invention;

FIG. 4-2 is a perspective view from below of the exposure device according to the embodiment of the invention;

FIG. 6 is a diagram exemplifying the shift amount S for each radius r of the image carrier in the case of assuming that the optical axis shift amount δ is 2 mm;

FIG. 10 is a diagram exemplifying the state in which the image is elongated in the scanning direction of the image carrier by the beam output by the exposure device for each radius r of the image carrier;

FIG. 13-1 is a perspective view from above of the first modified example of the exposure device according to the embodiment of the invention;

FIG. 13-2 is a perspective view from below of the first modified example of the exposure device according to the embodiment of the invention;

FIG. 14-1 is a perspective view from above of the second modified example of the exposure device according to the embodiment of the invention; and FIG. 14-2 is a perspective view from below of the second modified example of the exposure device according to the embodiment of the invention.

DETAILED DESCRIPTION OF THE INVENTION

Next, an embodiment of the invention will be described based on the drawings.

Figure 1:
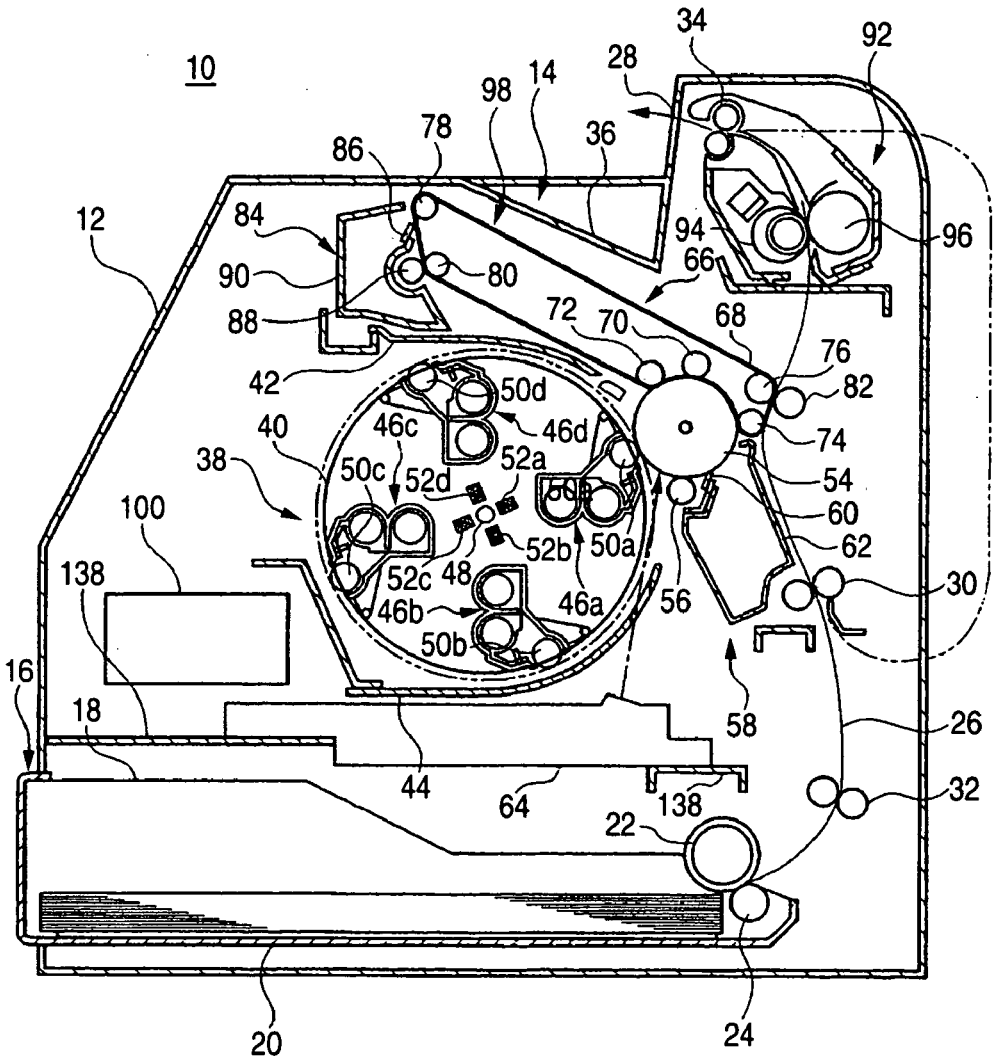
FIG. 1 shows the construction of an image forming apparatus according to an embodiment of the invention.

In FIG. 1, the scheme of an image forming apparatus 10 according to the embodiment of the invention is shown. The image forming apparatus 10 has an image forming apparatus main body 12, a discharging part 14, which will be described later, provided on the top of the image forming apparatus main body 12, and a paper feed unit 16, for example, of single stage is disposed at the bottom of the image forming apparatus main body 12.

The paper feed unit 16 has a paper feed unit main body 18 and a paper feed cassette 20 in which paper is accommodated. Near the top of the back end of the paper feed cassette 20, a feed roll 22 for feeding paper from the paper feed cassette 20 and a retard roll 24 for separating fed paper one by one are disposed.

A carrying path 26 is a paper path from the feed roll 22 to a discharge opening 28, and the carrying path 26 is located near the rear side of the image forming apparatus main body 12 (the right side face in FIG. 1) and formed substantially vertically from the paper feed unit 16 to a fixing unit 92, which will be described later. On the upstream side of the fixing unit 92 along the carrying path 26, a secondary transfer roll 82 and a secondary transfer backup roll 76, which will be described later, are disposed, and, on the upstream side of the secondary transfer roll 82 and the secondary transfer backup roll 76, a resist roll 30 is disposed. Between the resist roll 30 and the feed roll 22 and the retard roll 24, a feeding roll 32 is provided. Additionally, near the discharge opening 28 of the carrying path 26, a discharging roll 34 is disposed.

Therefore, the paper fed from paper feed cassette 20 of the paper feed unit 16 by the feed roll 22 is separated by the retard roll 24, and only the uppermost paper is guided to the carrying path 26, and temporarily stopped by the resist roll 30. Then, with provided timing, the paper is passed between the secondary transfer roll 82 and the secondary transfer backup roll 76, and the toner image is transferred onto the paper and the transferred toner image is fixed by the fixing unit 92, and the paper is discharged from the discharge opening 28 to the discharging part 14 by the discharging roll 34.

By the way, in the case where a reversing device (not shown) is provided to perform duplex printing as an option, as shown in FIG. 1 by a chain double-dashed line, the discharging roll 34 reversely rotates, and the paper is fed to the reversing device and returned to the resist roll 30.

The discharging part 14 has an inclined portion 36 rotatable relative to the image forming apparatus main body 12. The inclined portion 36 is inclined so as to be low at the part of the discharge opening 28 and gradually higher toward the front direction (in the leftward direction in FIG. 1).

In the image forming apparatus main body 12, a rotary developer unit 38 is disposed, for example, substantially at the center thereof. The rotary developer unit 38 includes a developer unit main body 40, a top plate 42, and a bottom plate 44. The developer unit main body 40 has developing parts 46*a* to 46*d* for forming toner images of four colors of yellow, magenta, cyan, and black, respectively, and rotates in the left-handed direction (counter-clockwise in FIG. 1) with the center of the rotary developer unit 48 as the center thereof. The developing parts 46*a* to 46*d* have developing rolls 50*a* to 50*d*, and are pressed in the normal direction of the developer unit main body 40 by elastic bodies 52*a* to 52*d* such as coil springs, for example, respectively. That is, the developing rolls 50*a* to 50*d* of the developing parts 46*a* to 46*d* are disposed on the periphery of the developer unit main body 40 at 90° intervals, respectively, with the center of the rotary developer unit 48 as the center thereof, and abut an image carrier 54 that includes a photoconductor, for example, to visualize the latent image on the image carrier 54 with the toner of the respective colors.

The image carrier 54 is disposed so as to abut the rotary developer unit 38, and a charging device 56 that includes a charging roll, for example, for uniformly charging the image carrier 54 is provided below the image carrier 54. Additionally, a first cleaner 58 abuts the image carrier 54 on the upstream side of the charging device 56 in the rotating direction of the image carrier 54. The first cleaner 58 includes, for example, a cleaning blade 60 for scraping the residual toner on the image carrier 54 after the primary transfer, and a first toner collection bottle 62 for collecting the toner scraped by the cleaning blade 60.

Below the rotary developer unit 38, an exposure device 64 for writing a latent image onto the image carrier 54 that has been charged by the charging device 56 with a beam such as a laser beam is disposed. Additionally, above the rotary developer unit 38, an intermediate transfer device 66 for primary-transferring the toner image that has been visualized by the rotary developer unit 38 is provided.

The intermediate transfer device 66 includes, for example, an intermediate transfer body 68 such as an intermediate transfer belt, a primary transfer roll 70, a wrap-in roll 72, a wrap-out roll 74, the secondary transfer backup roll 76, a scraper backup roll 78, and a brush backup roll 80. The intermediate transfer body 68 has elasticity, for example, and wrapped around the image carrier 54 by a predetermined range and turns dependently on the rotation of the image carrier 54. That is, the intermediate transfer body 68 abuts the image carrier 54 in a wrapped manner between the wrap-in roll 72 disposed upstream of the primary transfer roll 70 and the wrap-out roll 74 disposed downstream of the primary transfer roll 70, the toner images on the image carrier 54 are primary-transferred by the primary transfer roll 70, by superposing them in the order of, for example, yellow, magenta, cyan, and black, and the primary-transferred toner image is carried toward the secondary transfer roll 82, which will be described later.

Note that the wrap-in roll 72 and the wrap-out roll 74 are separated from the image carrier 54.

The scraper backup roll 78 helps a scraper 86, which will be described later, to scrape the residual toner on the intermediate transfer body 68 after the secondary transfer, and the brush backup roll 80 helps a brush roll 88, which will be described later, to scrape the residual toner on the intermediate transfer body 68 after the secondary transfer.

To the secondary transfer backup roll 76 of the intermediate transfer device 66, the secondary transfer roll 82 is opposed with the carrying path 26 therebetween. That is, the position between the secondary transfer roll 82 and the secondary transfer backup roll 76 is the secondary transfer position, and the secondary transfer roll 82 secondary-transfers the toner image that has been primary-transferred onto the intermediate transfer body 68 onto the paper in the secondary transfer position with the aid of the secondary transfer backup roll 76. Here, the secondary transfer roll 82 is designed so as to separate from the intermediate transfer body 68 when the intermediate transfer body 68 rotates three times, that is, holds the toner images of three colors of yellow, magenta, and cyan, and abut the intermediate transfer body 68 after the toner image of black is transferred thereon. Note that a predetermined difference in potential is produced between the secondary transfer roll 82 and the secondary transfer backup roll 76 such that, when the secondary transfer roll 82 is applied with a high voltage, the secondary transfer backup roll 76 is connected to the ground (GND).

Against the downstream side of the secondary transfer position in the intermediate transfer device 66, a second cleaner 84 abuts. The second cleaner 84 includes, for example, the scraper 86 for cleaning by scraping the residual toner on the intermediate transfer body 68 after the secondary transfer, the brush roll 88 for further scraping the toner remaining after the cleaning by the scraper 86, a second toner collection bottle 90 for collecting the scraped toner by the scraper 86 and the brush roll 88. The scraper 86 includes a stainless thin plate, for example, and is applied with a predetermined voltage. The brush roll 88 includes a brush of conductive treated acryl, for example. Additionally, while holding the toner images on the intermediate transfer body 68, the scraper 86 and the brush roll 88 are separated from the intermediate transfer body 68, and, with predetermined timing, these abut integrally against the intermediate transfer body 68.

Above the secondary transfer position, the fixing unit 92 is disposed. The fixing unit 92 has a heating roll 94 and a pressure roll 96, fixes the toner image that has been secondary-transferred onto the paper by the secondary transfer roll 82 and the secondary transfer backup roll 76 on the paper, and carries the paper toward the discharging roll 34.

An image forming unit 98 is formed by integrating the image carrier 54, the charging device 56, the intermediate transfer device 66, the first cleaner 58, and the second cleaner 84. The image forming unit 98 is disposed immediately below the inclined portion 36 of the discharging part 14, and attached or detached by opening the inclined portion 36.

Note that the timing of paper passing through the carrying path 26, the timing of the image carrier 54 exposed by the exposure device 64, the timing of the toner transferred onto the intermediate transfer body 68, the timing of the toner image on the intermediate transfer body 68 transferred on to the paper are controlled by a control unit 100.

Next, the image carrier 54, the rotary developer unit 38, and the exposure device 64 will be described in detail.

Figure 2:
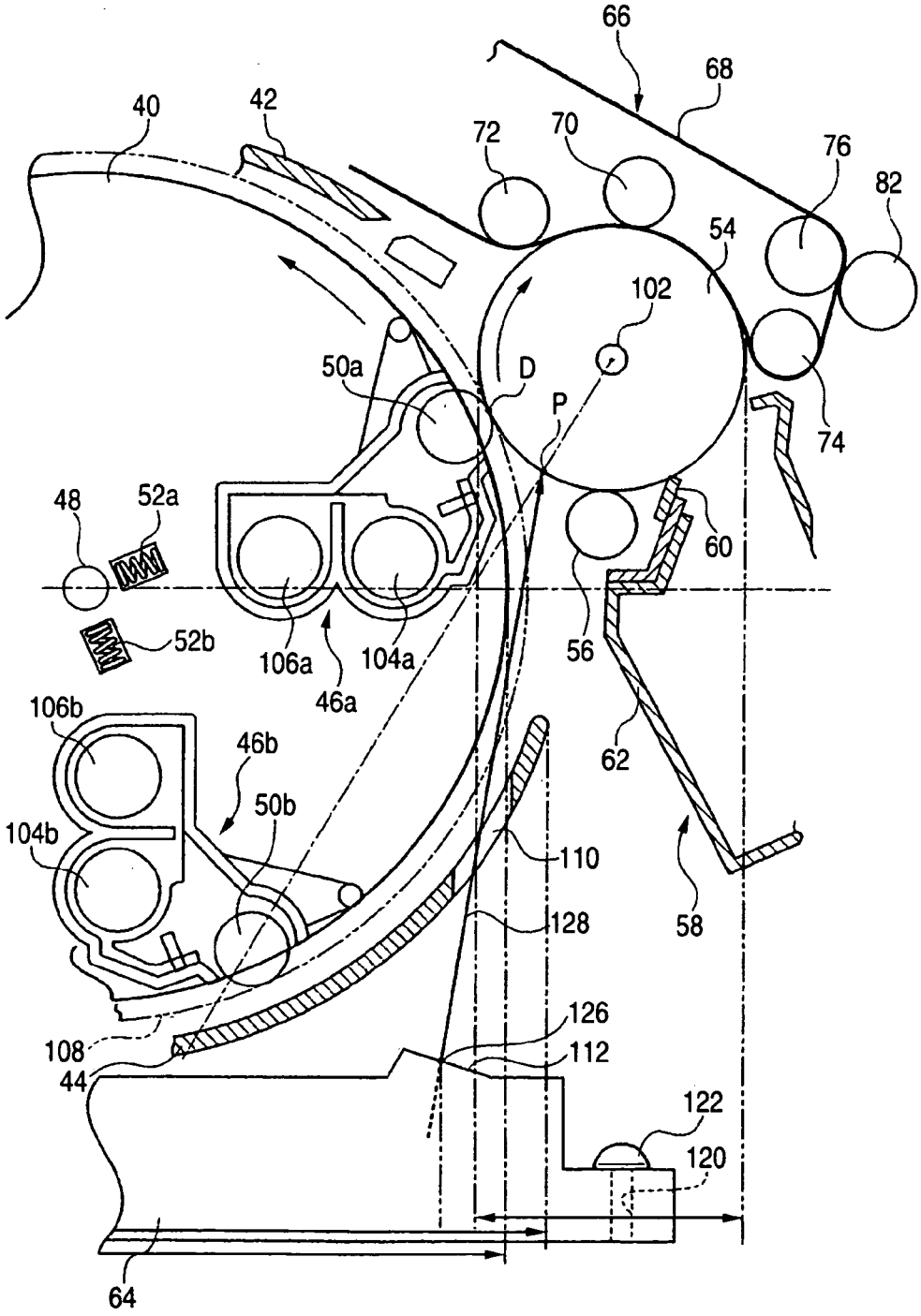
FIG. 2 shows the positional relationship among the image carrier, the beam exit position of the exposure device, and the rotary developer unit.
Figure 3:
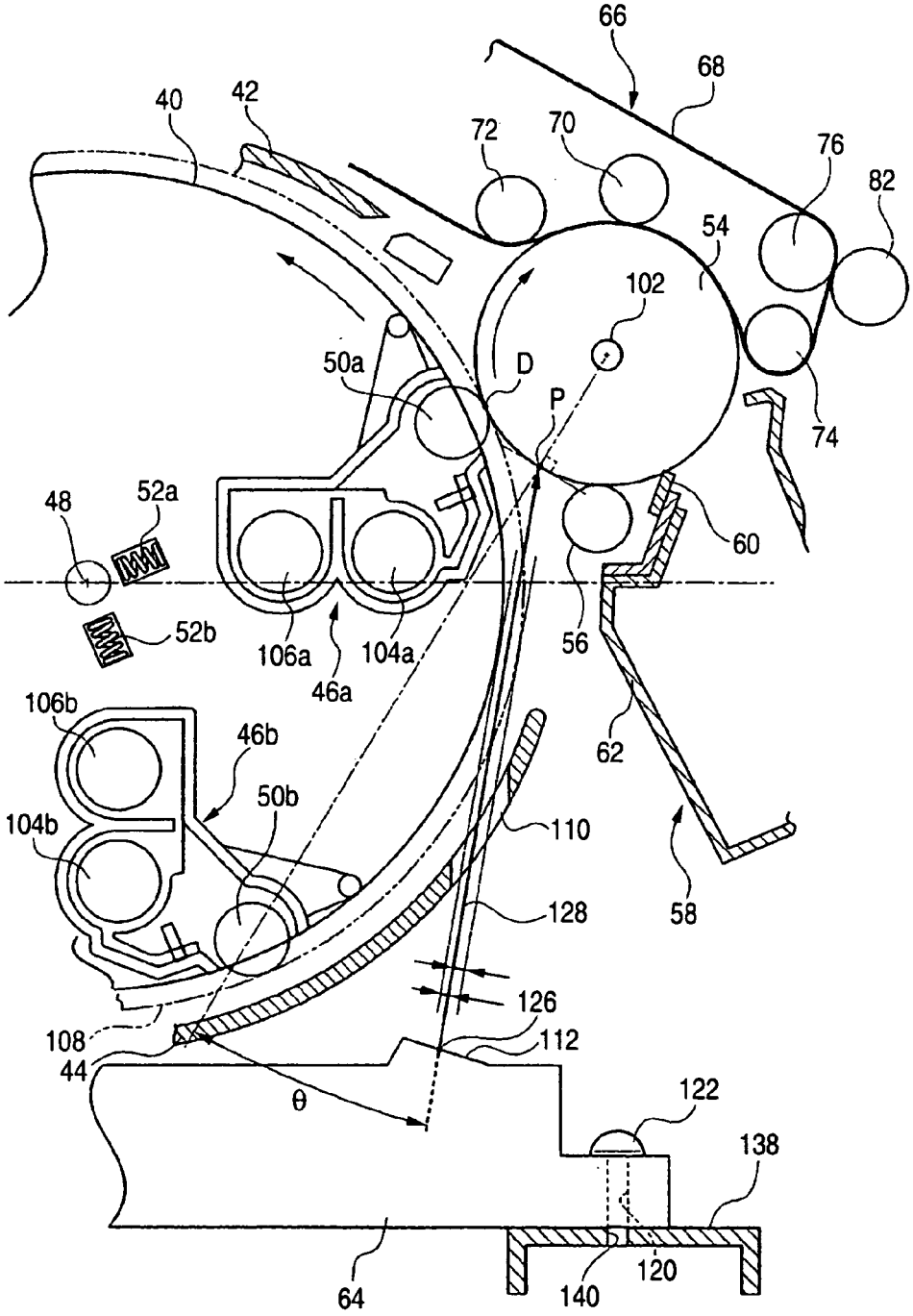
FIG. 3 shows the construction and the positional relationship among the image carrier, the exposure device, and the rotary developer unit.

In FIGS. 2 and 3, the constitution and positional relationship among the image carrier 54, the beam exit position of the exposure device 64, and the rotary developer unit 38 are shown. The image carrier 54 includes a tubular aluminum pipe of 10 to 20 mm in radius, for example, and a light sensitive layer is formed on the surface thereof. Further, the image carrier 54 is disposed so that a developing position D in which the image carrier 54 abuts the developing rolls 50*a* to 50*d* may be provided above the horizontal line passing the rotary developer unit center 48 of the rotary developer unit 38, and driven so that the circumference of the image carrier 54 may rotate in the developing position D from the lower side to the upper side (clockwise in FIGS. 1 to 3) with the image carrier center 102 as an axis thereof by a driving unit (not shown).

The rotary developer unit 38 includes the developing parts 46*a* to 46*d* as described above, and the developing parts 46*a* to 46*d* include the developing rolls 50*a* to 50*d*, supply augers 104*a* to 104*d* for stirring the toner, admixing augers 106*a* to 106*d*, respectively. Each of the developing rolls 50*a* to 50*d* has a circumference a part of which projects from the circumference of the developer unit main body 40 by 2 mm, for example, toward the radial direction in the state without abutting the image carrier 54. Further, on both ends of the developing rolls 50*a* to 50*d*, tracking rolls (not shown) having slightly larger diameters than those of the developing rolls 50*a* to 50*d* are provided so as to rotate coaxially with the developing rolls 50*a* to 50*d*, respectively.

Therefore, when the rotary developer unit 38 visualizes the latent image on the image carrier 54, the tracking rolls of the developing rolls 50*a* to 50*d* abut the image carrier 54, respectively, and thereby, the developing rolls 50*a* to 50*d* abut the image carrier 54 with predetermined pressure. Further, since the developing parts 46*a* to 46*d* are movable in the radial direction of the developer unit main body 40 by the elastic bodies 52*a* to 52*d*, when the rotary developer unit 38 visualizes the latent image, the developing position D is within a circumscribed circle 108 circumscribed by the four developing rolls 50*a* to 50*d* disposed on the periphery of the developer unit main body 40.

In the bottom plate 44 of the rotary developer unit 38, a beam passing portion 110 such as a notch or hole for passing through the beam output by the exposure device 64 is disposed below the rotary developer unit 38.

Figures 1, 4:
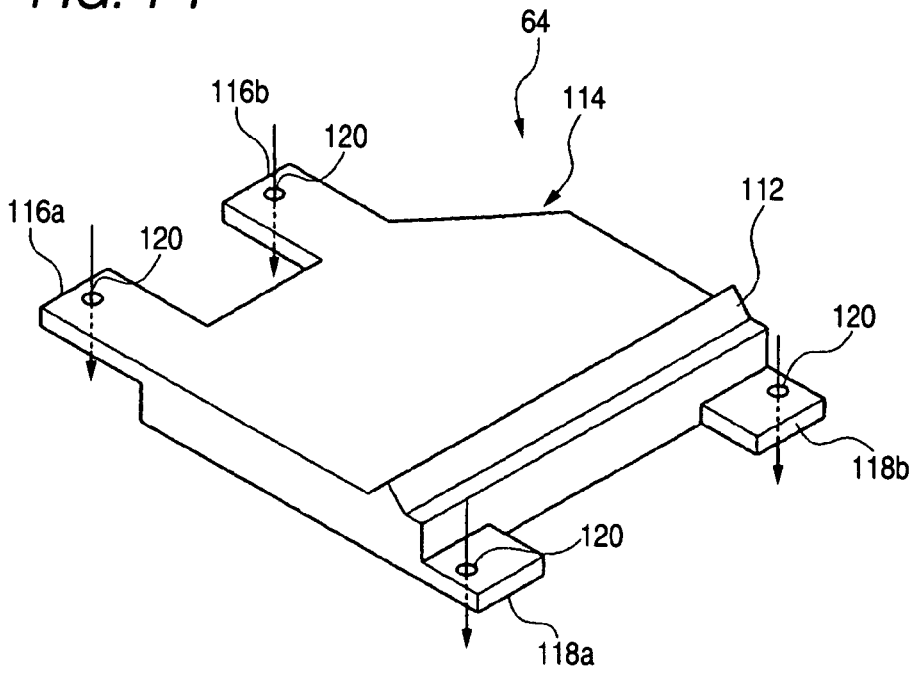
Figures 2, 4:
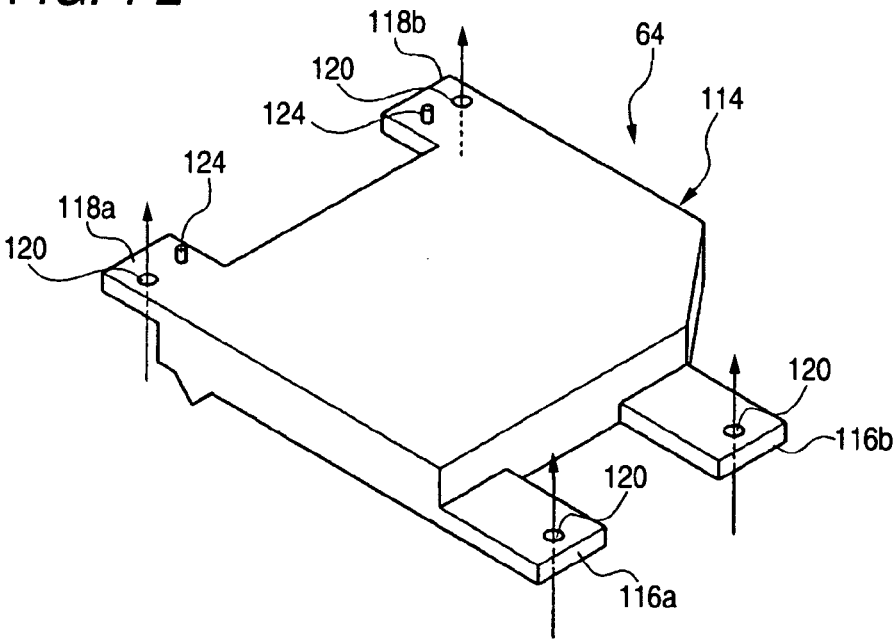

The exposure device 64 has an exposure device main body 114 including an exit window 112 for outputting the beam, and, for example, two front side mounting portions 116*a*, 116*b*, and two rear side mounting portions 118*a*, 118*b*, as also shown in FIGS. 4-1 and 4-2. In the front side mounting portions 116*a*, 116*b* and the rear side mounting portions 118*a*, 118*b*, hole portions 120 such as screw holes are provided, respectively. On the other hand, in the image forming apparatus main body 138 (FIGS. 1 and 3), mounted portions 140. (FIG. 3) including screw holes are provided. That is, the hole portions 120 and the mounted portions 140 are fastened, for example, by a fastening members 122 including screws from above, and thereby, the exposure device 64 is fastened to the image forming apparatus main body 138 substantially horizontally. Further, for example, the rear side mounting portions 118*a*, 118*b* are provided with positioning pins 124, respectively, and thereby, the position of the exposure device 64 relative to the rotary developer unit 38 and the image carrier 54 can be determined with high accuracy.

By the way, the image forming apparatus main body 12 provided with the discharging part 14 and the image forming apparatus main body 138 provided with the mounted portions 140 (FIG. 3) may be integrated.

The exposure device main body 114 has a scanner motor, a polygon mirror rotated by the scanner motor, a laser source emitting a laser beam, a cylindrical lens, a reflecting mirror built-in. Additionally, the exit window 112 (exit portion) is provided on the top of the exposure device main body 114 and near the right end of FIG. 4-1, and the exposure device 64 is disposed so that a beam exit position 126 in the exit window 112 may be located below the horizontal line passing the rotary developer unit center 48 of the rotary developer unit 38. The beam exit position 126 is disposed so as to be out of the region formed by downwardly and vertically projecting the image carrier 54 to the rotary developer unit side, within the region formed by downwardly and vertically projecting the bottom plate 44, and within the region formed by downwardly and vertically projecting the developer unit main body 40.

Further, the exposure device 64 is disposed in the mounting position within the image forming apparatus main body 12, for example, by being slid laterally relative to the image forming apparatus main body 138. That is, the exposure device 64 can be attached or detached below the rotary developer unit 38, and thereby, can be exchanged without detaching the rotary developer unit 38 from the image forming apparatus main body 12.

The beam output from the beam exit position 126 of thus disposed exposure device 64 passes through the beam passing portion 110, then, passes between the circumference of the developer unit main body 40 and the circumscribed circle 108, and the surface of the image carrier 54 is exposed in an exposure position P on the image carrier 54 with the beam at an incident angle θ relative to the normal line of the image carrier 54. That is, an optical path 128 of the beam from the beam exit position 126 of the exposure device 64 to the exposure position P on the image carrier 54 is formed. The optical path 128 passes inside the circumscribed circle 108 by 1.5 mm, for example, and the distance to the circumference of the developer unit main body 40 is 0.5 mm, for example.

By the way, the form of the developer unit main body 40 may be adjusted to allow the beam to pass inside the circumference of the developer unit main body 40.

As described above, since the exposure device 64 is fastened by the fastening member 122, even if vibration is generated by the operation of the scanner motor (not shown), the beam output by the exposure device 64 is prevented from being disturbed. Additionally, since the hole portions 120 are provided on the ends of the front side mounting portions 116*a*, 116*b* and the rear side mounting portions 118*a*, 118*b*, respectively, and located outside of the region formed by vertically projecting the rotary developer unit 38, even when the exposure device main body 114 is disposed below the rotary developer unit 38, the working space for attaching and detaching the fastening member 122 by using a tool such as a driver can be assured. Further, as also shown in FIG. 4-1, since the front side mounting portions 116*a*, 116*b* of the exposure device 64 are provided respectively on the top side of the exposure device 64, the space for drawing the paper feed cassette 20 from the paper feed unit 16 toward the front side (left side in FIG. 1) can be taken broader.

Next, the operation of the above described embodiment will be described.

When an image forming signal is transmitted from the control unit 100, the image carrier 54 is uniformly charged by the charging device 56, and, to the charged image carrier 54, a beam is output from the exposure device 64 based on the image signal. The beam from the exposure device 64 passes through the beam passing portion 110, then, passes between the circumference of the developer unit main body 40 and the circumscribed circle 108, and the surface of the image carrier 54 is exposed in the exposure position P on the image carrier 54 with the beam at an incident angle θ relative to the normal line of the image carrier 54, and thus, a latent image is formed. The latent image on the image carrier 54 formed by the exposure device 64 has toner images of yellow, magenta, cyan, and black visualized by the rotary developer unit 38 and transferred onto the intermediate transfer body 68 by being superposed.

On the other hand, the paper accommodated in the paper feed cassette 20 with the paper feed signal or the like is fed by the feed roll 22, separated by the retard roll 24 to be guided to the carrying path 26, temporarily stopped by the resist roll 30, and passed between the secondary transfer roll 82 and the secondary transfer backup roll 76 with provided timing. When the paper is passed between the secondary transfer roll 82 and the secondary transfer backup roll 76, the toner image that has been transferred onto the intermediate transfer body 68 is transferred onto the paper by the secondary transfer roll 82 and the secondary transfer backup roll 76.

The paper onto which the toner image has been transferred is guided to the fixing unit 92, and the toner image is fixed by the thermal pressure by the heating roll 94 and the pressure roll 96. The paper onto which the toner image has been fixed is discharged from the discharge opening 28 to the discharging part 14 by the discharging roll 34. Note that, in the case of performing duplex printing by mounting an option, the discharging roll 34 reversely rotates, and the paper is fed to the reversing device (not shown) and returned to the resist roll 30, and then, guided between the secondary transfer roll 82 and the secondary transfer backup roll 76 again, passes through the fixing unit 92, and discharged from the discharge opening 28 to the discharging part 14.

Next, the incident angle of the beam output by the exposure device 64 relative to the image carrier 54 will be described in detail.

The position in which the image carrier 54 is exposed with the beam output from the exposure device 64 exhibits a certain amount of variations (parallel shift of the optical axis) in the manufacture of the image forming apparatus 10. Therefore, it is preferred that the defects of the image formed by the image forming apparatus 10 due to the variations of the position in which the exposure is performed with the beam are reduced by defining the incident angle of the beam output by the exposure device 64 relative to the image carrier 54.

Figure 5:
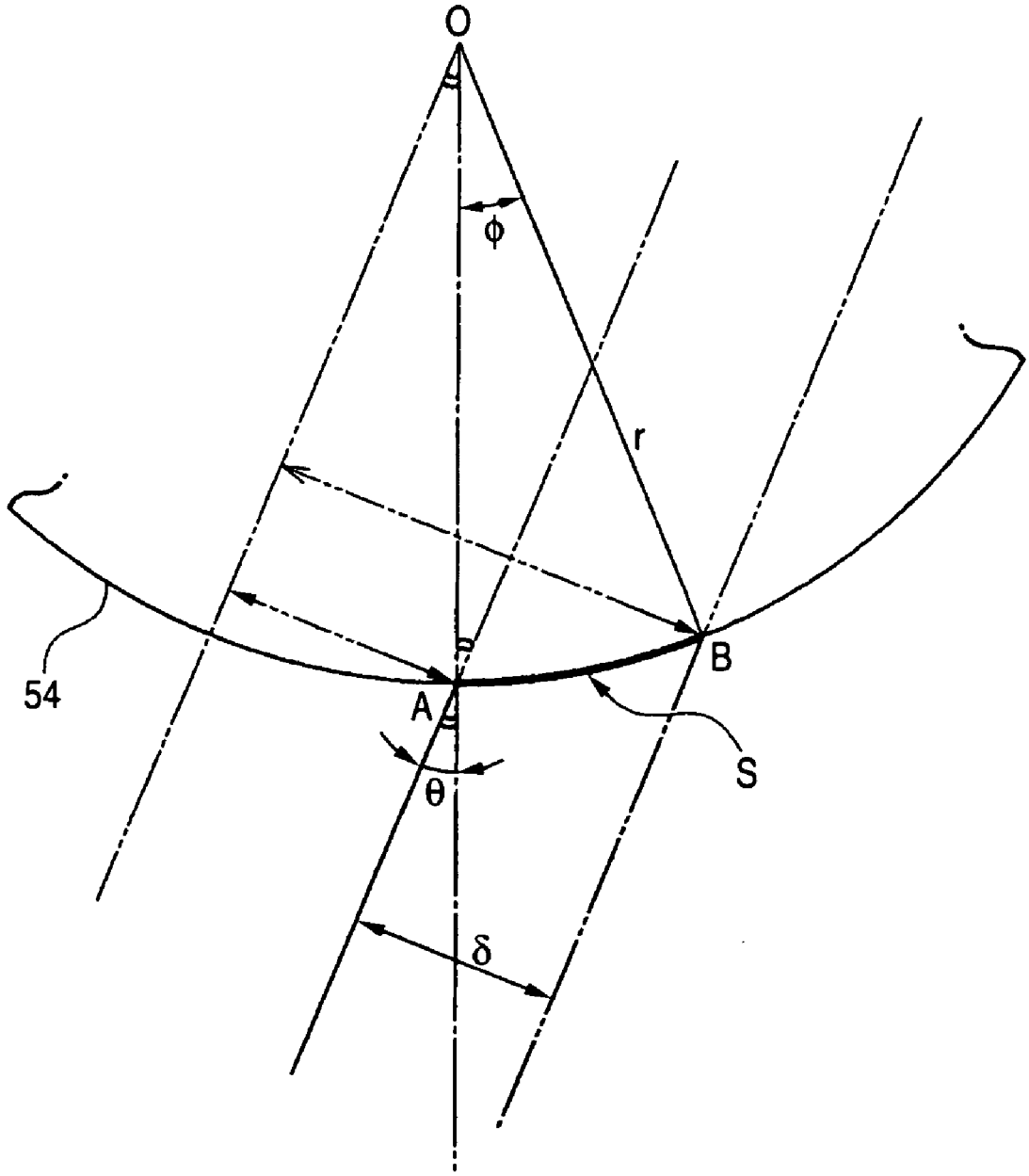
FIG. 5 schematically shows the incident angle of the beam output by the exposure device relative to the image carrier and the shift amount shifted on the image carrier in the case where the beam is shifted in parallel along the circumferential direction of the image carrier.

FIG. 5 schematically shows the incident angle of the beam output by the exposure device 64 relative to the image carrier 54 and the shift amount shifted on the image carrier 54 in the case where the beam is shifted in parallel along the circumferential direction of the image carrier 54. In FIG. 5, the radius r of the image carrier 54, the incident angle θ of the predetermined beam output by the exposure device 64, the shift width (distance between the predetermined beam and the shifted beam: optical axis shift amount) δ in the case where the beam output by the exposure device 64 is shifted in parallel along the circumferential direction of the image carrier 54, the shift angle Φ of the exposure position B of the shifted beam relative to the exposure position A of the predetermined beam on the image carrier 54, and the distance (shift amount S) between the exposure position A of the predetermined beam and the exposure position B of the shifted beam on the surface of the image carrier 54 are shown. Therefore, the following expression (1) is held.

$$\text{optical axis shift amount } \delta = r\{\sin(\Phi+\theta) - \sin\theta\} \quad (1)$$

Further, if the unit of the incident angle θ and shift angle Φ is radian, the following expression (2) is held.

$$\text{shift amount } S = r\cdot\Phi = r\cdot\{\sin-1(\delta/r+\sin\theta)\cdot\theta\} \quad (2)$$

In addition, FIG. 5 schematically shows the variations of the image position relative to the paper feeding direction and the beam diameter of the beam due to the shift of the timing of the resist roll 30, and the beam output by the exposure device 64. For example, in the case where, by considering changes in image quality due to the timing adjustment of the resist roll 30 and the variation of the beam diameter of the beam, the condition that the ratio of the shift amount S to the optical axis shift amount δ is made equal to or less than 1.2 is set as the condition for defining the incident angle θ, the incident angle θ is defined by the condition represented by the following expression (3).

$$\delta \leqq r\{\sin-1(\delta/r+\sin\theta)\cdot\theta\} \leqq 1.2\delta \quad (3)$$

Figure 7:
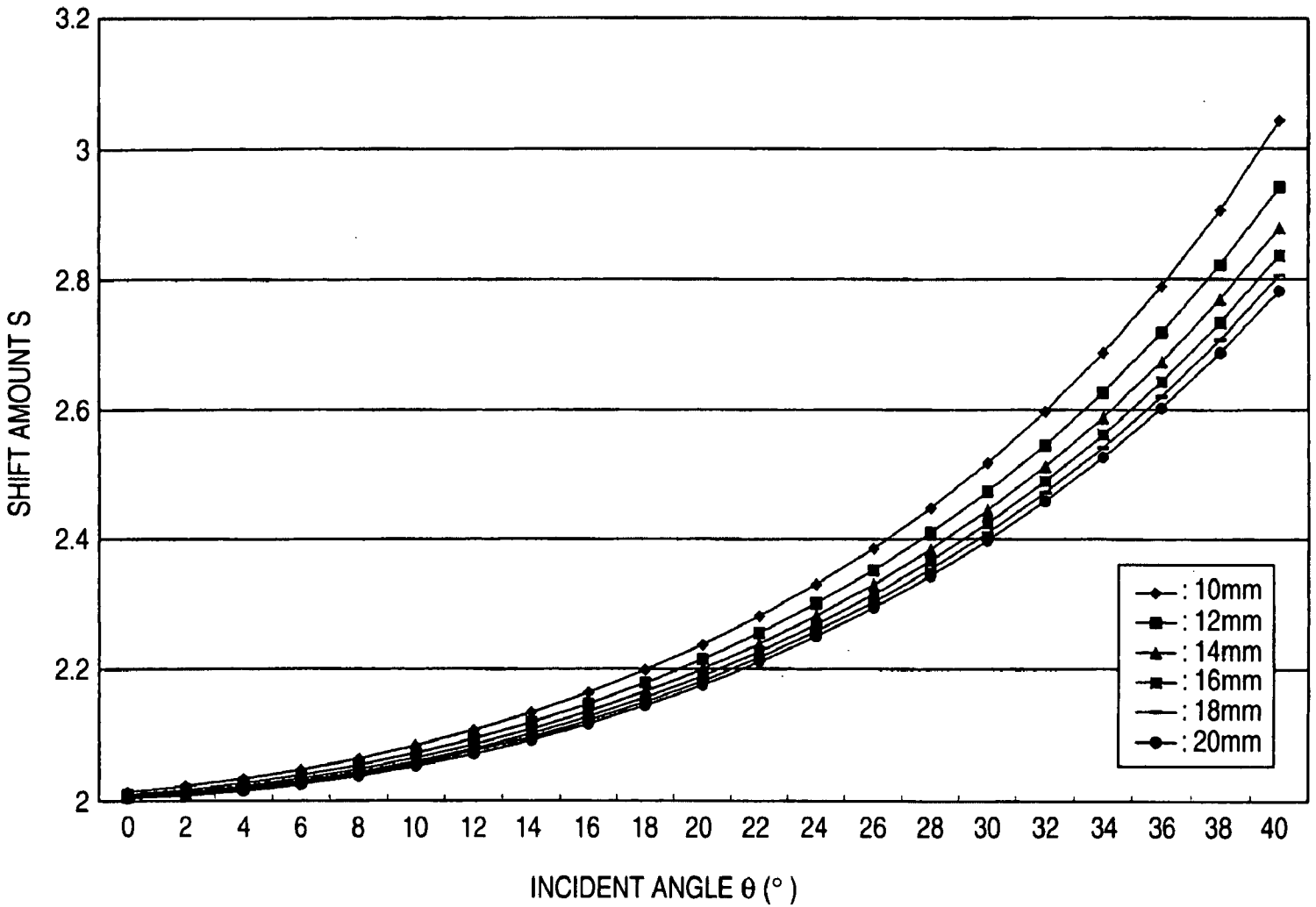
FIG. 7 is a graph showing the shift amount S shown in FIG. 6 for each incident angle.
Figure 8:
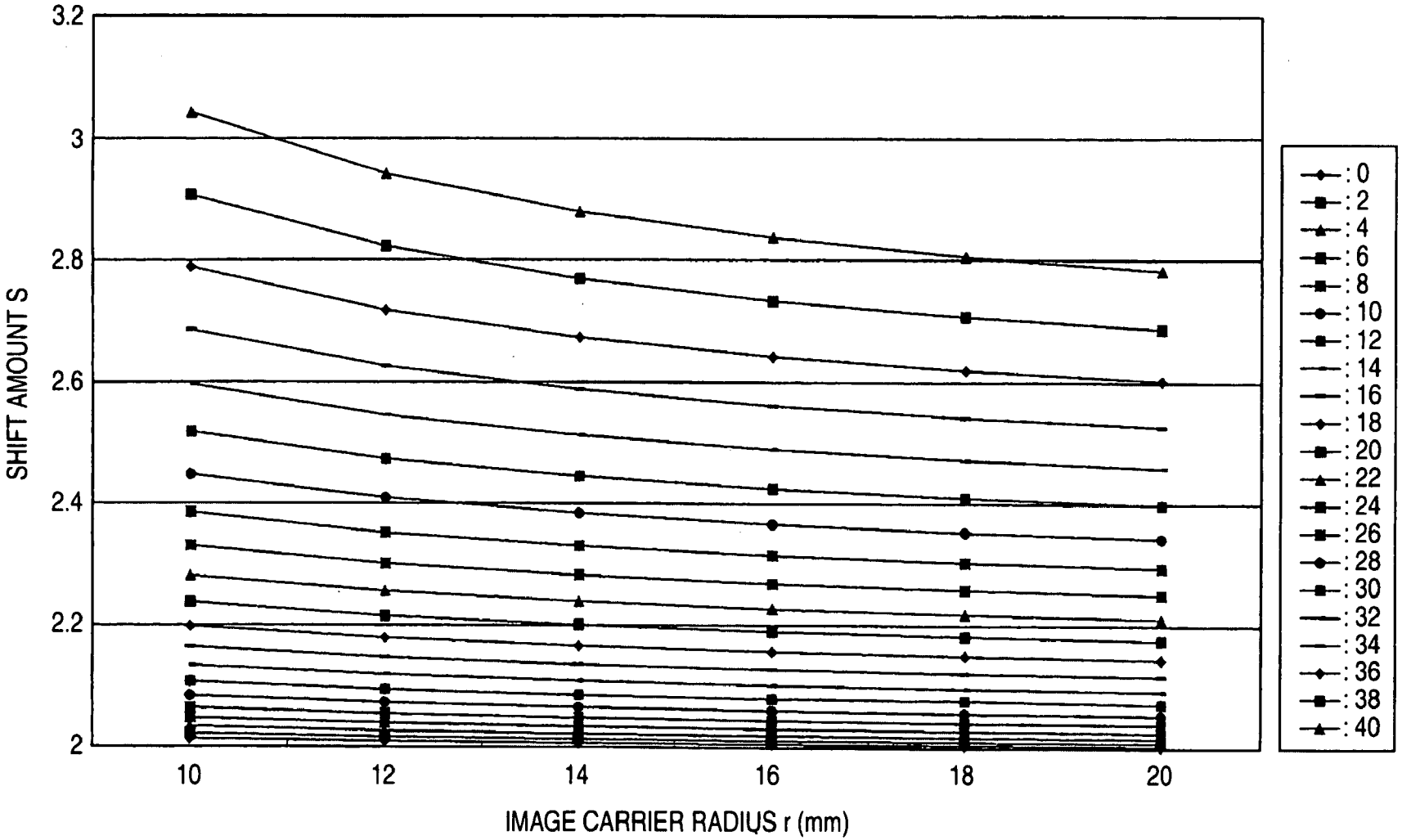
FIG. 8 is a graph showing the shift amount S shown in FIG. 6 for each radius r of the image carrier.

In FIGS. 6 to 8, the shift amount S (in units of millimeter) in the case of assuming that the optical axis shift amount δ is 2 mm is exemplified for each radius r (in units of millimeter) of the image carrier 54. For example, when the radius of the image carrier 54 is 10 to 20 mm, the incident angle θ is preferably set to equal to or less than about 30° (about 0.524 radian) so as to satisfy the condition of the expression (3).

Figure 9:
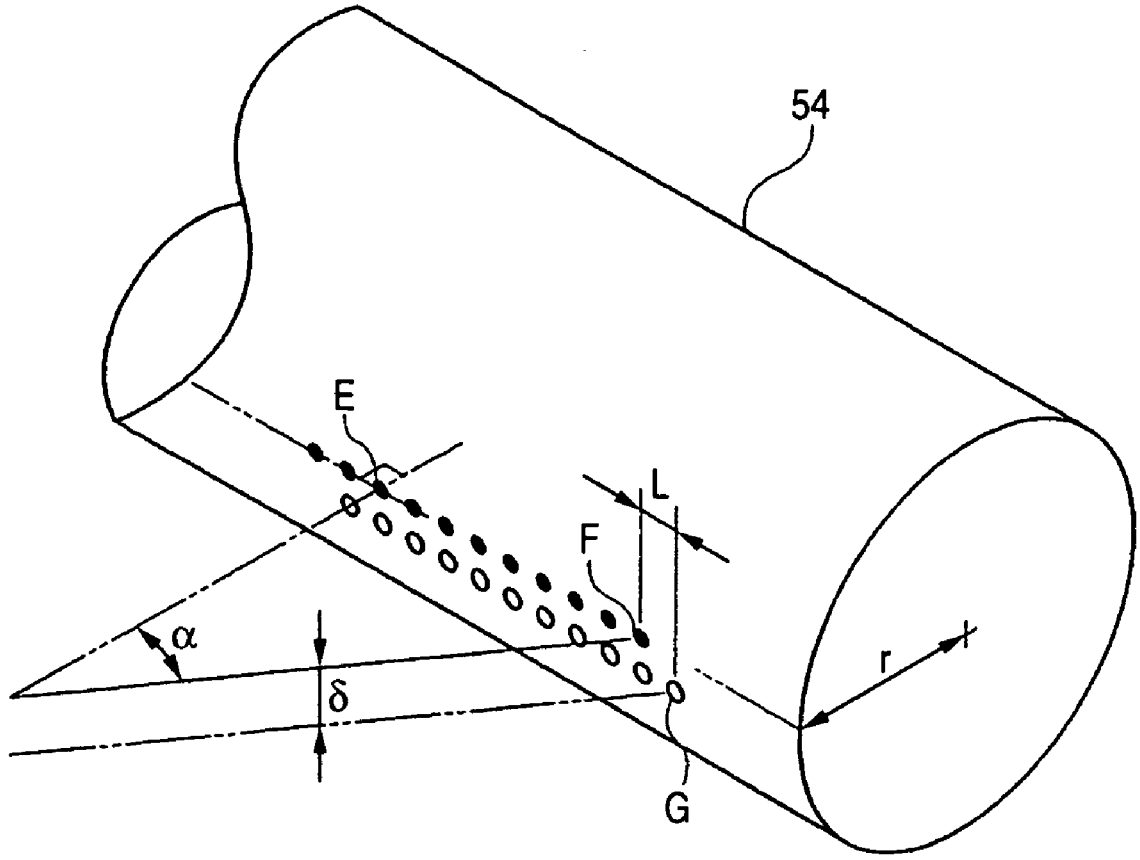
FIG. 9 schematically shows the state in which the image is elongated in the scanning direction of the image carrier by the beam output by the exposure device.

FIG. 9 schematically shows the state in which the image is elongated in the scanning direction of the image carrier 54 by the beam output by the exposure device 64. In FIG. 9, the radius r of the image carrier 54, the exit angle (image angle) α at which the predetermined beam output by the exposure device 64 exits toward the scanning end F relative to the exposure direction to the exposure position E in the image carrier 54 in which the exposure is performed with the predetermined beam output by the exposure device 64 perpendicular to the scanning direction of the image carrier 54, the shift width (distance between the predetermined beam and the shifted beam: optical axis shift amount) δ in the case where the beam output by the exposure device 64 is shifted relative to the scanning end F, and the distance (elongation amount L) between the scanning end G shifted by the distance of the optical axis shift amount δ and the scanning end F along the scanning direction are shown.

Note that, in the state shown in FIG. 9, the variables substantially the same as the variables shown in FIG. 5 such as the incident angle θ and the shift angle Φ are similarly used. Therefore, the following expression (4) is held.

$$\text{elongation amount } L = r\{\cos\theta - \cos(\theta+\Phi)\}\cdot\tan\alpha \quad (4)$$

Further, substituting the relationship of the expression (4) into the expression (1), the following expression (5) is held.

$$L = r\{\cos\theta\cdot\cos(\sin-1(\delta/r+\sin\theta))\}\cdot\tan\alpha \quad (5)$$

For example, in the case where, by considering the change in the image in the scanning direction (lateral magnification of the image), the condition that the elongation amount L relative to the optical axis shift amount δ is made equal to or less than 0.5 mm is set as the condition for defining the incident angle θ, the incident angle θ is defined by the condition represented by the following expression (6).

$$|r\cdot\{\cos\theta\cdot\cos(\sin-1(\delta/r+\sin\theta))\}\cdot\tan\alpha|\leqq 0.5 \quad (6)$$

Figure 11:
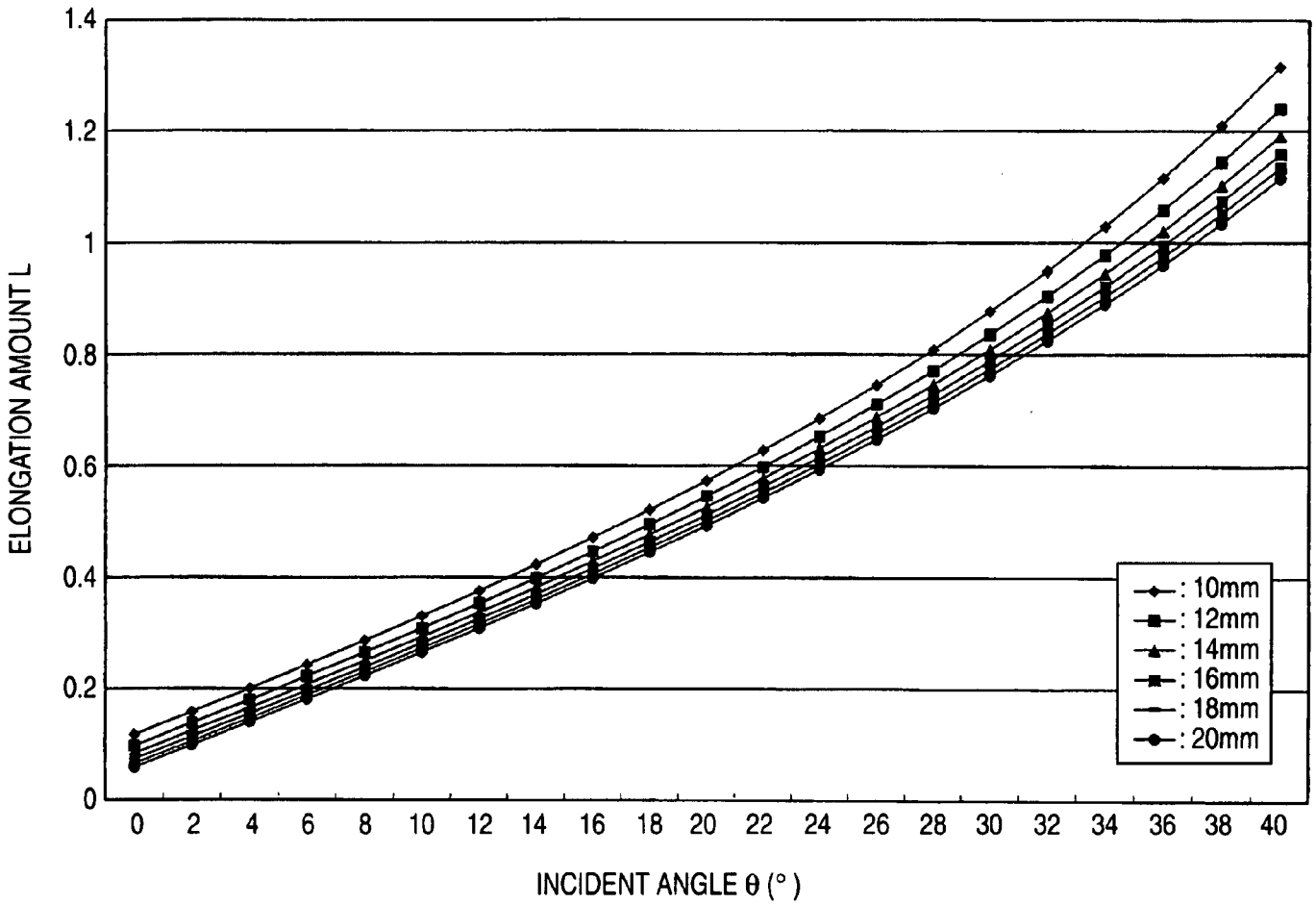
FIG. 11 is a graph showing the elongation amount L shown in FIG. 10 for each incident angle.
Figure 12:
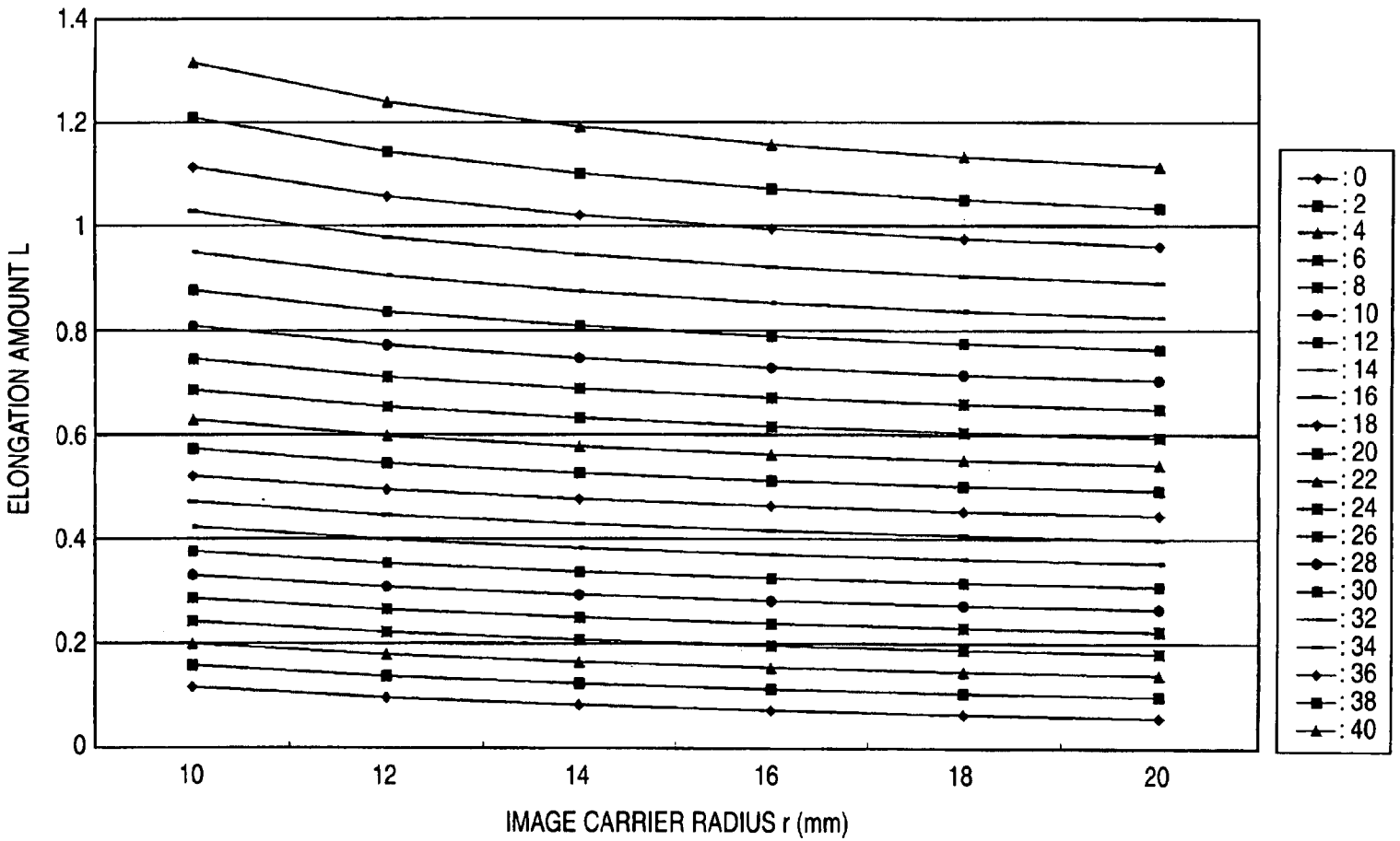
FIG. 12 is a graph showing the elongation amount L shown in FIG. 10 for each radius r of the image carrier.

In FIGS. 10 to 12, the elongation amount L (in units of millimeter) in the case of assuming that the exit angle (image angle) α of the beam is about 30° (about 0.524 radian), and the optical axis shift amount δ is 2 mm is exemplified for each radius r (in units of millimeter) of the image carrier 54. For example, when the radius of the image carrier 54 is 10 to 20 mm, the incident angle θ is preferably set to equal to or less than about 20° (about 0.349 radian) so as to satisfy the condition of the expression (6).

As described above, since the incident angle of the beam on the image carrier can be made smaller relative to the normal line of the image carrier even when the exit position of the beam for writing the latent image onto the image carrier is approximated to the rotary developer unit, the image forming apparatus can be miniaturized while maintaining good exposure performance.

Further, since the incident angle of the beam is set to equal to or less than 30° relative to the normal line of the image carrier, the energy loss due to reflection of the beam can be reduced. More preferably, the incident angle of the beam is set to equal to or less than 20° relative to the normal line of the image carrier.

Note that, in the case where the incident angle of the beam is set to 0° relative to the normal line of the image carrier, since the beam is reflected to the beam exit position 126, the incident angle of the beam is preferably set to more than 0°, and equal to or less than 30° or equal to or less than 20° relative to the normal line of the image carrier.

Figures 1, 13:
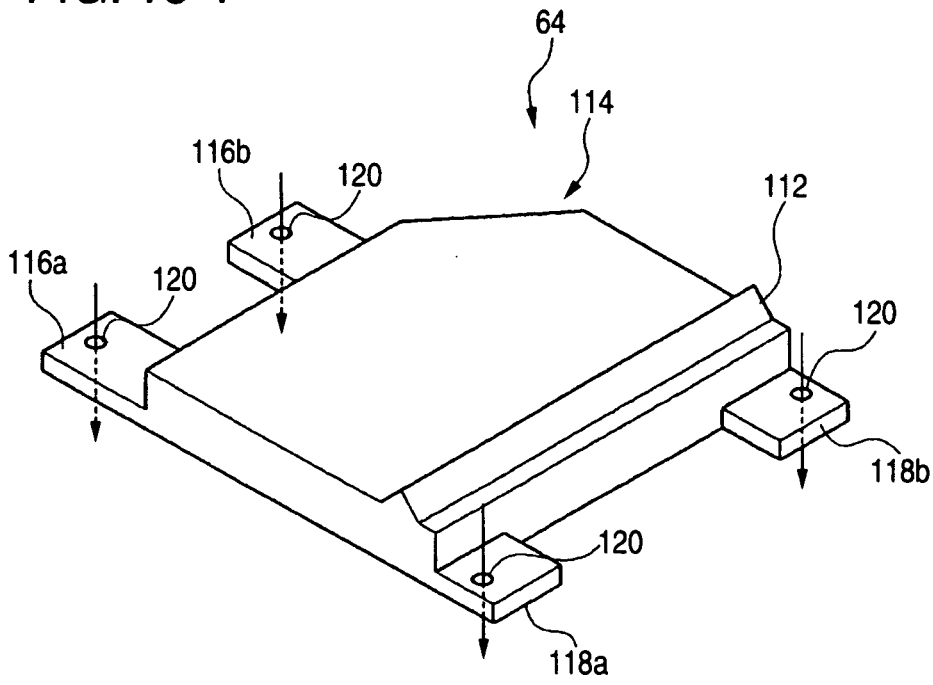
Figures 2, 13:
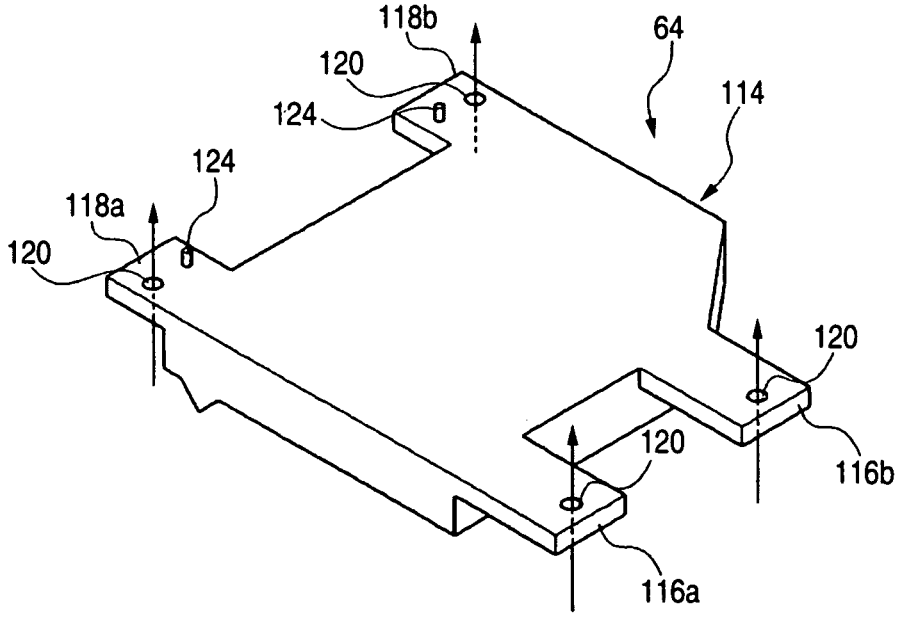

Next, the first modified example of the exposure device 64 will be described. FIGS. 13-1 and 13-2 show the first modified example of the exposure device 64. As shown in FIGS. 13-1 and 13-2, in the first modified example, the exposure device 64 is different from the exposure device 64 shown in the above described embodiment in the point where the exposure device 64 has the exposure device main body 114 including the exit window 112 for outputting the beam and, for example, the two front side mounting portions 116*a*, 116*b* and the two rear side mounting portions 118*a*, 118*b*, but the two front side mounting portions 116*a*, 116*b* are disposed on the bottom face side of the exposure device main body 114. Thus, even if the direction in which the hole portion 120 is fastened by the fastening member 122 in the exposure device 64 of the first modified example is the same as that in the exposure device 64 shown in the above described embodiment, by changing the positions in which the two the front side mounting portions 116*a*, 116*b* are provided, the space within the image forming apparatus main body 12 can be effectively used in different applications.

Figures 1, 14:
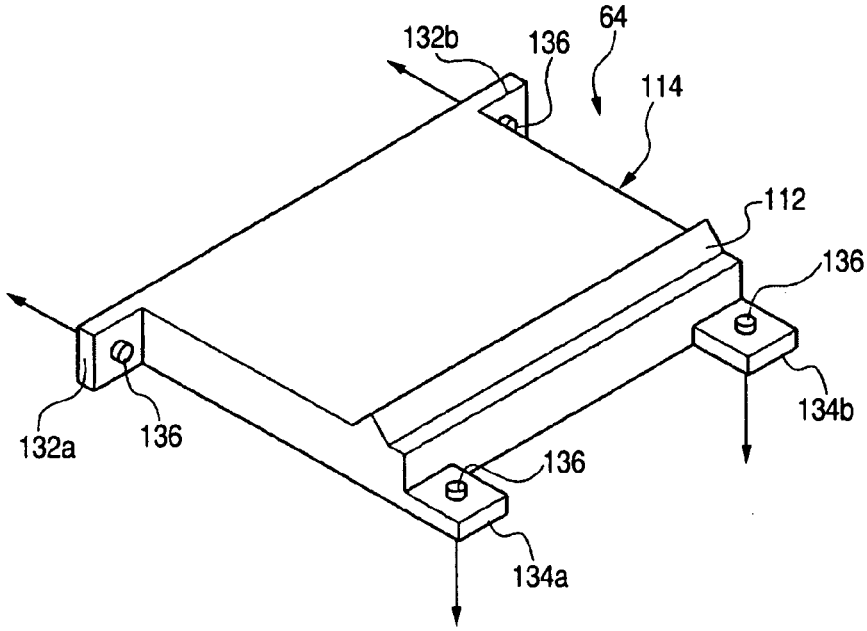
Figures 2, 14:
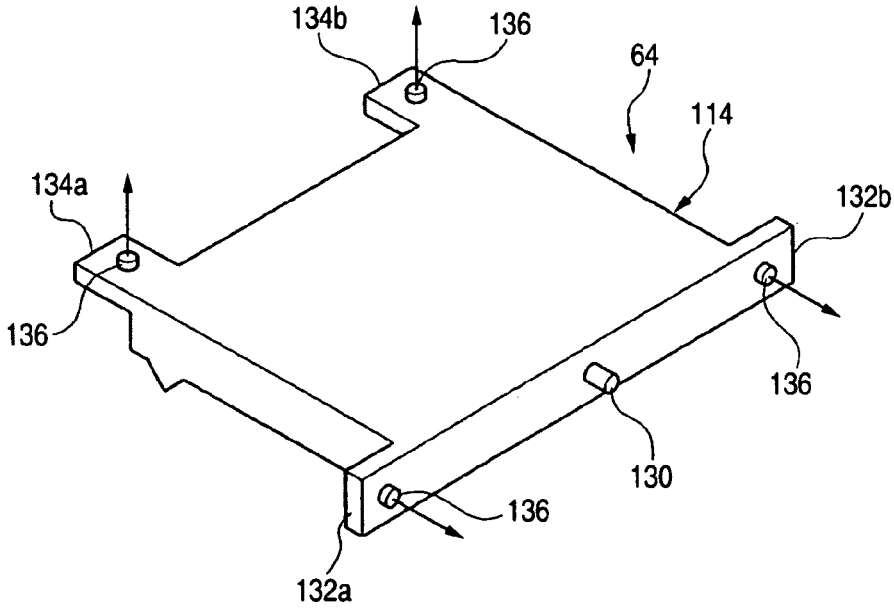

Next, the second modified example of the exposure device 64 will be described. FIGS. 14-1 and 14-2 show the second modified example of the exposure device 64. As shown in FIGS. 14-1 and 14-2, in the second modified example, the exposure device 64 includes the exposure device main body 114 having the exit window 112 for outputting the beam, a front side positioning portion 130, two vertical mounting portions 132*a*, 132*b*, and two rear side mounting portions 134*a*, 134*b*. The vertical mounting portions 132*a*, 132*b* and the rear side mounting portions 134*a*, 134*b* are provided with fastening members 136 such as screws, respectively. Thus, since the exposure device 64 can be fastened in the horizontal and vertical directions in the second modified example, even if the exposure device 64 is subject to vibration from a different direction, the beam output by the exposure device 64 can be prevented from being disturbed. Further, in the exposure device 64 of the second modified example, the length along the longitudinal direction (rightward and leftward direction in FIG. 1) can be made shorter relative to that in the exposure device 64 shown in the above described embodiment, and thereby, the space within the image forming apparatus main body 12 can be made broader.

The entire disclosure of Japanese Patent Application No. 2003-337794 filed on Sep. 29, 2003 including specification, claims, drawings and abstract is incorporated herein by reference in its entirety.

What is claimed is:

1. An image forming apparatus comprising:

an image carrier;

a rotary developer unit that has a developing roll opposed to the image carrier when located at a developing position; and an exposure device that writes a latent image onto the image carrier;

wherein an optical path from the exposure device to the image carrier passes within a circumscribed circle of the developing roll with the center of rotation of the rotary developer unit as the center of the circle.

2. The image forming apparatus according to claim 1, wherein the exposure device outputs a beam to make an incident angle of the beam on the image carrier, which is equal to or less than 30 degrees relative to the normal line of the image carrier.

3. The image forming apparatus according to claim 1, wherein the exposure device has a mounting portion, and the mounting portion is mounted to the main body of the image forming apparatus outside of the region formed by vertically projecting the rotary developer unit.

4. The image forming apparatus according to claim 1, wherein the exposure device is disposed in a mounted position by being slid relative to the main body of the image forming apparatus.

5. An image forming apparatus comprising:

an image carrier;

a rotary developer unit that has a developing roll opposed to the image carrier when located at a developing position; and an exposure device that writes a latent image onto the image carrier;

wherein the image carrier is located to provide the developing position above a horizontal line passing the center of rotation of the rotary developer unit, and the exposure device is located to provide a beam exit position below the horizontal line and out of a region formed by vertically projecting the image carrier to the rotary developer unit side.

6. An image forming apparatus comprising:

an image carrier;

a rotary developer unit that has a developing roll opposed to the image carrier when located at a developing position; and an exposure device that writes a latent image onto the image carrier;

wherein the image carrier is located to provide the developing position above a horizontal line passing the center of rotation of the rotary developer unit, and the exposure device is located to provide a beam exit position below the horizontal line and within a region formed by vertically projecting the rotary developer unit.

7. The image forming apparatus according to claim 6, wherein the rotary developer unit further has a bottom plate, and the exposure device is located to provide the beam exit position within a region formed by vertically projecting the bottom plate.

8. The image forming apparatus according to claim 7, wherein a beam passing portion is formed in the bottom plate, and an optical path from the exposure device to the image carrier via the beam passing portion is formed.

9. An image forming apparatus comprising:

an image carrier;

a rotary developer unit that has a developing roll opposed to the image carrier when located at a developing position; and an exposure device that writes a latent image onto the image carrier;

wherein the exposure device is located below the rotary developer unit, and outputs a beam in a direction substantially the same as a direction of rotation of the rotary developer unit.

10. An image forming apparatus comprising:

an image carrier;

a rotary developer unit that has a plurality of developing parts and moving to a developing position in which each of the developing parts is opposed to the image carrier by rotating around a predetermined center of rotation; and an exposure device disposed to allow light output by the exposure device to pass inside of a circumscribed circle along which the developing parts rotate.

11. The image forming apparatus according to claim 10, wherein an incident angle of the light output by the exposure device is equal to or less than 30 degrees relative to the image carrier.

12. The image forming apparatus according to claim 11, wherein the rotary developer unit further has a bottom plate, and the exposure device is located to provide a beam exit position within a region formed by vertically projecting the bottom plate.

13. The image forming apparatus according to claim 12, wherein a beam passing portion is formed in the bottom plate, and an optical path from the exposure device to the image carrier via the beam passing portion is formed.

14. The image forming apparatus according to claim 10, wherein the image carrier is located to provide the developing position above a horizontal line passing the center of rotation of the rotary developer unit, and the exposure device is located to provide a beam exit position below the horizontal line and out of a region formed by vertically projecting the image carrier to the rotary developer unit side.

15. The image forming apparatus according to claim 10, wherein the image carrier is located to provide the developing position above a horizontal line passing the center of rotation of the rotary developer unit, and the exposure device is located to provide a beam exit position below the horizontal line and within a region formed by vertically projecting the rotary developer unit.

* * * * *